United States Patent [19]

Saluja et al.

[11] Patent Number: 5,025,359

[45] Date of Patent: Jun. 18, 1991

[54] COUNTERBALANCED ARM FOR A LIGHTHEAD

[75] Inventors: Raja Saluja; Arthur T. Nagare, both of Erie, Pa.

[73] Assignee: American Sterilizer Company, Erie, Pa.

[21] Appl. No.: 495,248

[22] Filed: Mar. 16, 1990

[51] Int. Cl.[5] ..... F21V 21/15

[52] U.S. Cl. ..... 362/402; 362/288; 362/427; 248/295.1; 248/325

[58] Field of Search ..... 248/325, 324, 295.1; 362/401, 402, 285, 280, 418, 427, 389, 390

[56] References Cited

U.S. PATENT DOCUMENTS

| | | | |
|---|---|---|---|
| 2,911,519 | 9/1956 | Phillips et al. | 250/1.4 |
| 3,010,013 | 4/1958 | Gunther et al. | 240/1.4 |
| 3,240,925 | 12/1962 | Paschke et al. | 240/1.4 |
| 3,360,640 | 4/1965 | Seitz et al. | 240/1.4 |
| 3,936,671 | 2/1976 | Bobrick et al. | 240/46.59 |
| 4,032,775 | 6/1977 | Bobrick et al. | 240/73 |
| 4,080,530 | 3/1978 | Krogsrud | 362/402 |
| 4,097,919 | 6/1978 | Bobrick et al. | 362/270 |
| 4,130,858 | 12/1978 | Hayakawa | 362/150 |
| 4,494,177 | 1/1985 | Matthews | 362/402 |
| 4,517,632 | 5/1985 | Roos | 362/389 |
| 4,744,019 | 5/1988 | Krogsrud | 363/402 |
| 4,770,384 | 9/1988 | Kuwazima et al. | 362/402 |

FOREIGN PATENT DOCUMENTS 1112023 8/1961 Fed. Rep. of Germany .

*Primary Examiner*—Ira S. Lazarus
*Assistant Examiner*—Peggy A. Neils
*Attorney, Agent, or Firm*—Kirkpatrick & Lockhart

[57] ABSTRACT

A counterbalanced arm for a lighthead has an upper arm portion, a lower arm portion adapted at one end to be connected to the lighthead and at the other end for articulation about the upper arm portion, and a pivot assembly connecting the upper arm portion to the lower arm portion. The pivot assembly defines a pivot axis about which the lower arm portion pivots with respect to the upper arm portion. A lever mechanism is positioned so that a first end is positioned on one side of the pivot axis and a second end is positioned on the opposite side of the pivot axis, with the first end being pivotally secured to either the upper arm portion or the lower arm portion. A pull rod is positioned within either the upper arm portion or the lower arm portion and is pivotally attached to the second end of lever mechanism. The pivot assembly and lever mechanism are designed to enable the lower arm portion to pivot about the pivot axis from a position forming an acute angle with respect to the upper arm portion through a position forming a 180 degree angle with upper arm portion. A spring is operatively connected to the pull rod so that the spring provides a force to counterbalance the lighthead.

7 Claims, 5 Drawing Sheets

COUNTERBALANCED ARM FOR A LIGHTHEAD

BACKGROUND OF THE INVENTION

1. Field of the Invention

The present invention is directed generally to counterbalanced support arms and more specifically to a counterbalanced support arm used to support a lighthead suspended from a ceiling.

2. Description of the Prior Art

Counterbalanced support arms are well known and are used in such diverse applications as supporting robot arms and surgical lightheads. In surgical lighthead applications, two competing design criteria must be balanced. On the one hand, it is necessary for the surgical lighthead to remain fixed after being positioned by the surgeon or a member of the surgical team. On the other hand, the force needed to move the lighthead from one position to another must be as low as possible to enable very precise positioning with the least amount of force. It is clearly difficult to satisfy both those needs when suspending a sixty pound lighthead from the end of an arm. Thus, it is not uncommon in the art to find lightheads that tend to move from the position where they are placed without the application of external force due to the weight of the lighthead while other lightheads are too stiff to allow for minute adjustments.

Another problem area arises from limited maneuverability of the support arm. Because of new medical techniques, it is necessary to position lightheads used in certain healthcare facilities in positions heretofore not adequately addressed. For example, in some gynecological procedures, it is necessary for the lighthead, which is typically suspended from the ceiling, to be placed close to the floor and directed upwardly. The need for such a wide range of movement coupled with the need for the lighthead to be easily positioned throughout that range of movement without any drifting presents a difficult challenge to the design engineer.

BRIEF SUMMARY OF THE INVENTION

A counterbalanced arm for a lighthead is provided with an upper arm portion and a lower arm portion adapted at one end to be connected to the lighthead and at the other end for articulation about the upper arm portion. A pivot assembly connects the upper arm portion to the lower arm portion. The pivot assembly defines a pivot axis about which the lower arm portion pivots with respect to the upper arm portion. A lever mechanism is positioned so that the first end is positioned on one side of the pivot axis and a second end is positioned on the opposite side of the pivot axis. The first end is pivotally secured to either the upper arm portion or the lower arm portion. A pull rod is positioned within either the upper arm portion or the lower arm portion and is pivotally attached to the second end of the lever mechanism. The pivot assembly and lever mechanism are designed to enable the lower arm portion to pivot about the pivot axis from a position forming an acute angle with respect to the upper arm portion through a position forming a 180 degree angle with upper arm portion. A spring is operatively connected to the pull rod so that the spring provides a force to counterbalance the lighthead.

In one embodiment, the pivot assembly includes a pivot pin extending completely along the pivot axis. The lever assembly includes a link which is arcuate shaped and has a sufficient arc so that the link does not interfere with the pivot pin.

In another embodiment, the pivot assembly includes a pair of opposing pins extending partially along the pivot axis thereby creating a discontinuity in the pivot axis. The lever mechanism includes a straight link which operates through the discontinuity in the pivot axis.

The counterbalanced arm of the present invention provides an arm that can be very precisely positioned with a minimum of force and which does not drift. The arm allows the lighthead to be positioned over a wide range of positions while maintaining the force required to move the arm substantially constant over that range. Those, and other advantages and benefits of the present invention will be apparent from the Description of a Preferred Embodiment hereinbelow.

DESCRIPTION OF THE DRAWINGS

For the present invention to be easily understood and readily practiced, a preferred embodiment will now be described, for purposes of illustration only, in conjunction with the following figures in which.

DESCRIPTION OF A PREFERRED EMBODIMENT

Figure 1:
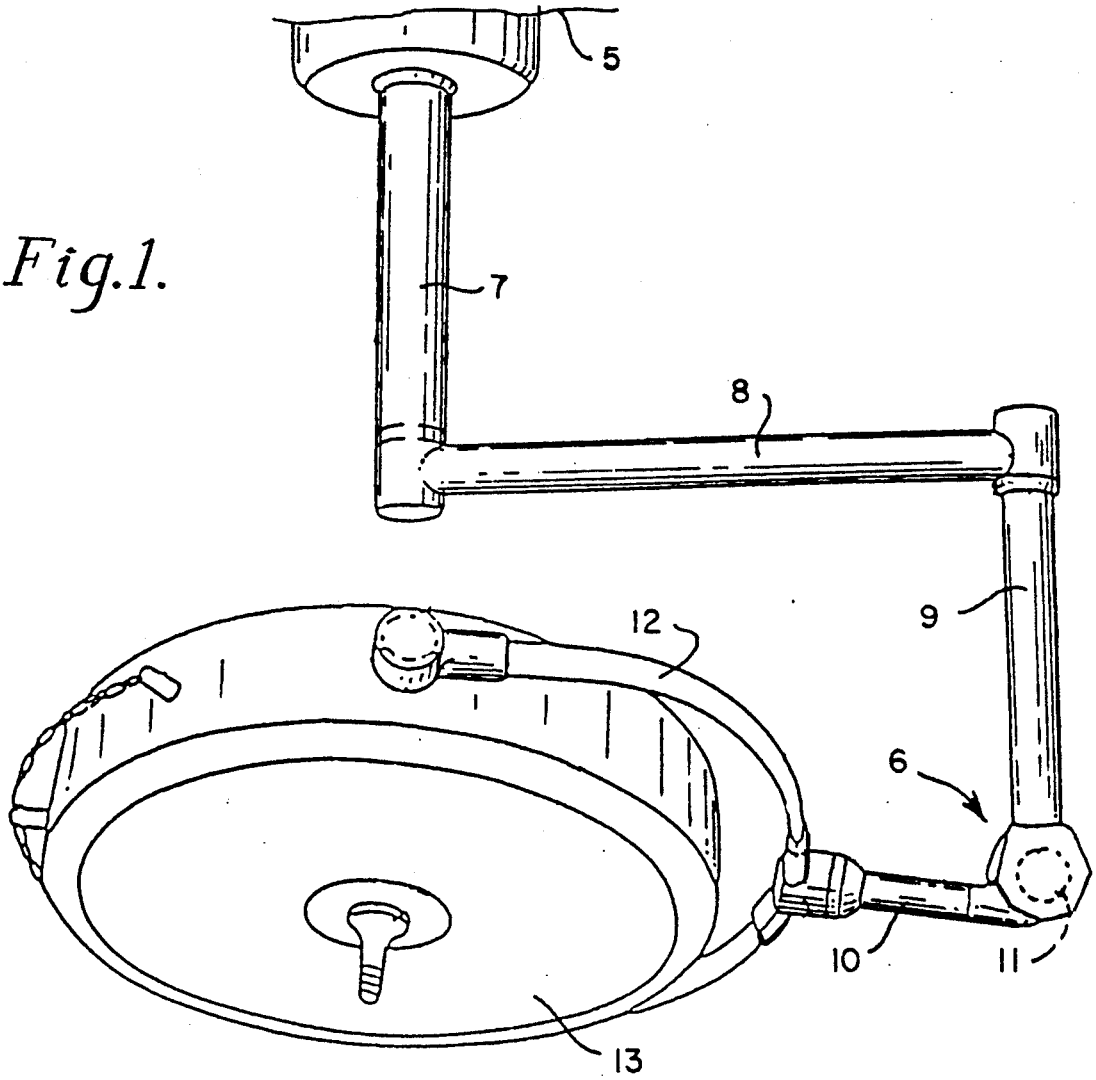
FIG. 1 is a perspective view of a counterbalanced arm constructed according to the teachings of the present invention.

A counterbalanced arm 6, constructed according to the teachings of the present invention is illustrated in FIG. 1. Although the present invention is described in conjunction with a lighthead used in a healthcare facility, specifically a surgical light in a surgical suite, the present invention may be used for other types of lightheads or even to counterbalance other types of loads, e.g. robot arms.

Referring to FIG. 1, the arm 6 is suspended from a ceiling 5. Depending on the height of the ceiling 5, a drop tube 7 and a horizontal tube 8 may be provided. Those portions of the arm do not form a part of the present invention and may not even be present at certain locations.

The arm 6 is also comprised of an upper arm portion 9 and a lower arm portion 10. A pivot assembly 11 is provided between the upper arm portion 9 and the lower arm portion 10. The pivot assembly 11 forms an important feature of the present invention. One end of the lower arm portion 10 is connected through a yoke 12 to a lighthead 13 in a conventional manner.

Figure 2:
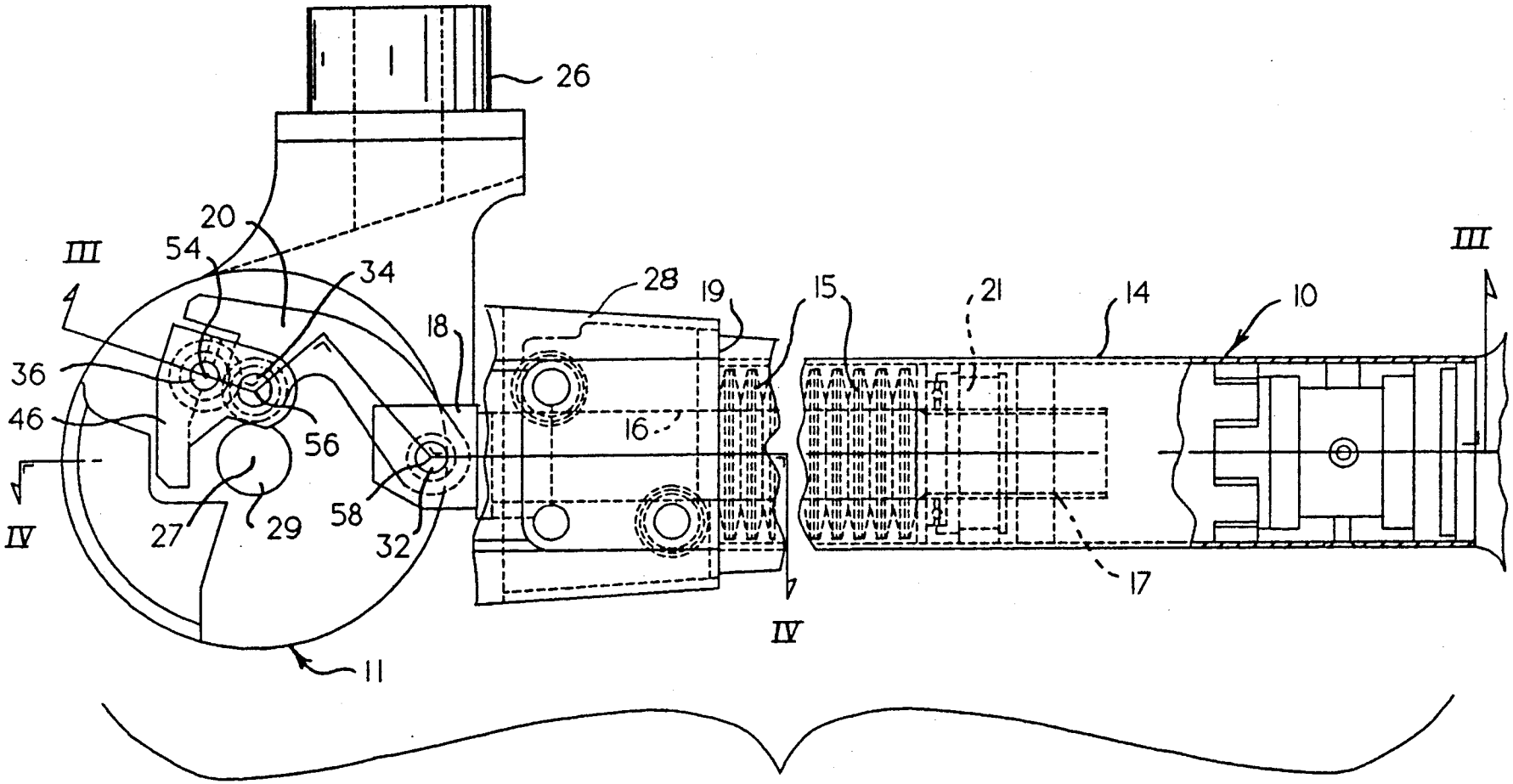
FIG. 2 is a side view of a portion of the counterbalanced arm illustrated in FIG. 1.
Figure 4:
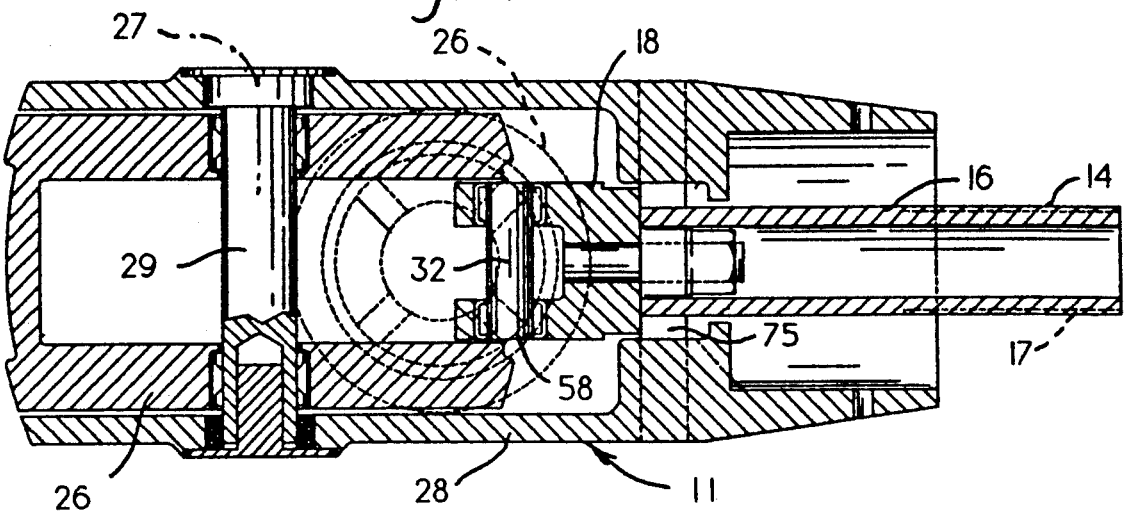
FIG. 4 is a sectional view of the counterbalanced arm illustrated in FIG. 2 taken along the line IV—IV.

Referring now to FIG. 2, a side view of the pivot assembly 11 and the lower arm portion 10 is illustrated. The pivot assembly 11 is comprised of an upper arm extension 26 adapted for rigid connection to the upper arm portion 9. The pivot assembly 11 is also comprised of a lower arm extension 28, seen best in FIG. 4, adapted for rigid connection to the lower arm portion 10. The upper arm extension 26 pivots with respect to the lower arm extension 28 about a pivot axis 27 formed by a pivot pin 29. Thus, the upper arm portion 9 and the lower arm portion 10 are similarly capable of pivoting with respect to one another about pivot axis 27.

Figure 3:
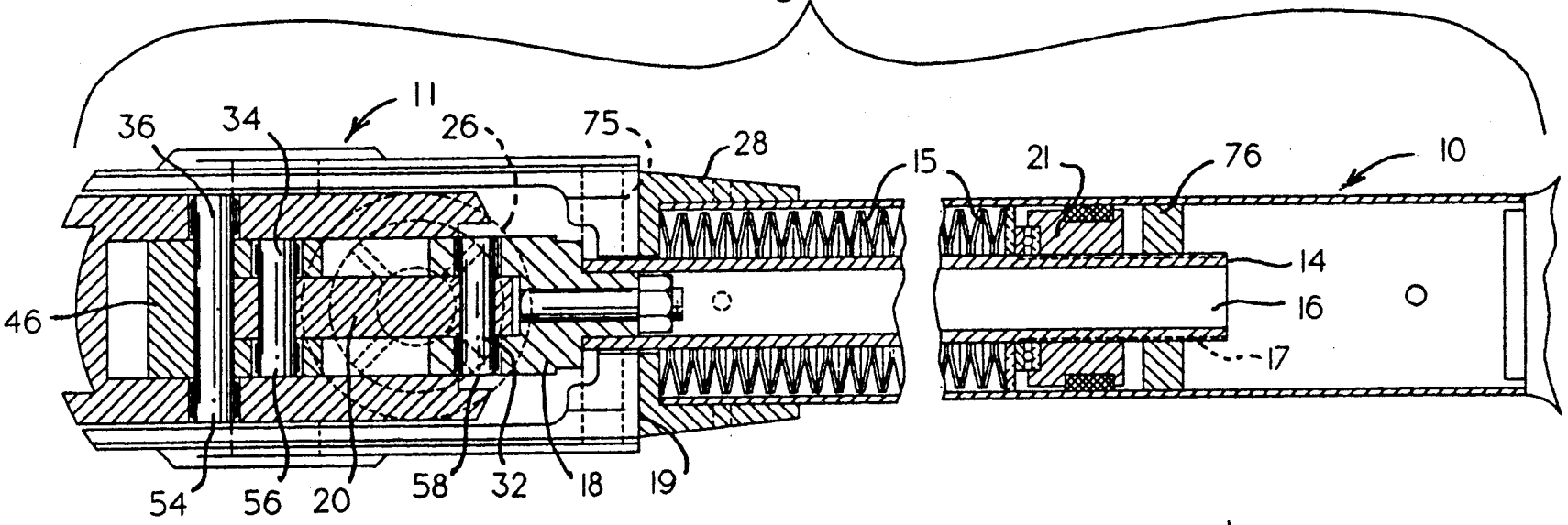
FIG. 3 is a view of the counterbalanced arm illustrated in FIG. 2 taken along the line III—III.
Figure 13:
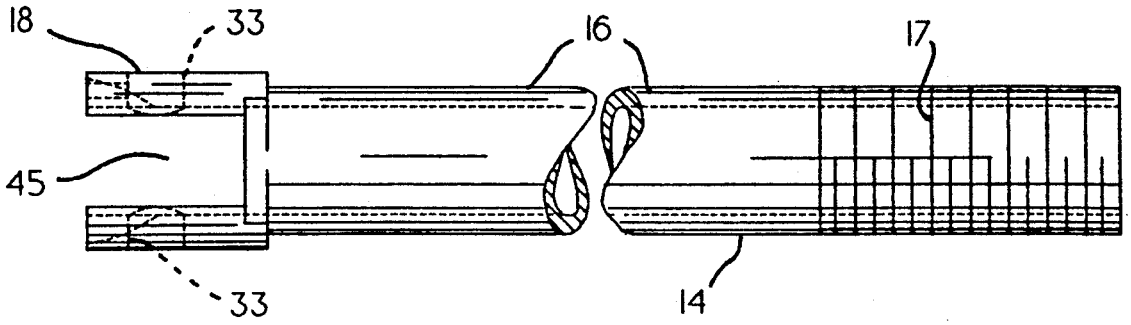
FIG. 13 is a top view of the pull rod illustrated in FIG. 12.
Figure 12:
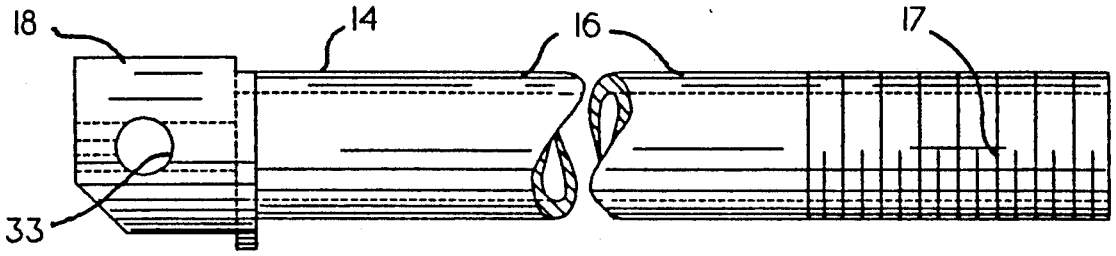
FIG. 12 is a front view of a pull rod.
Figure 14:
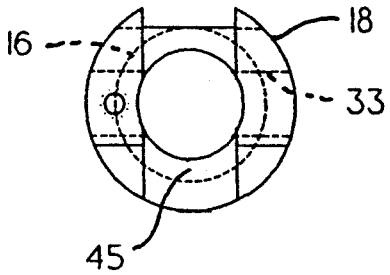
FIG. 14 is a side view of the pull rod illustrated in FIGS. 12 and 13.

A spring 15 comprised of beveled washers is used to generate the force needed to counterbalance the weight of the lighthead. The beveled washer spring 15 is housed within the lower arm portion 10 although it could also be housed in the upper arm portion 9. The spring 15 has a cylindrical opening therethrough as is known. A pull rod 14 is positioned within the cylindrical opening in the beveled washing spring 15 as shown in FIGS. 2 and 3. The pull rod 14, best seen in FIGS. 12, 13 and 14, is comprised of two main parts: a rod part 16 and a head part 18. The rod part 16 has threads 17 at one end. The rod part 16 guides and supports the beveled washers which comprise the beveled washer spring 15. Low friction rings 75 and 76 made from a material such as tetrafluoroethylene mounted inside the arm portion carrying the pull rod 14, can be used to guide and support the pull rod 14.

As seen in FIG. 2, the spring 15 is confined at one end by a shoulder 19 formed in the pivot assembly 11 and at the other end by a nut 21 carried on threads 17. Adjustment of the position of the nut changes the tension on the spring. Typically, the force of the spring 15 is at a maximum of 1,900 lbs. when the angle between the upper arm portion 9 and lower arm portion 10 is 180 degrees. The force of the spring is at a minimum of 1,000 lbs. when the angle between the upper arm portion 9 and lower arm portion 10 is 75 degrees. The force of spring 15 pushes on nut 21 and hence urges the pull rod 14 to the right in FIG. 2.

Those of ordinary skill in the art will recognize that as the position of the lighthead changes, the moment arm needed to counterbalance the weight of the lighthead changes. Thus, the force of spring 15 pushing on the nut 21 and pull rod 14 must be coupled through some type of link mechanism so that the force can be used to generate a moment arm appropriate for that position of the lighthead. The present invention contemplates the use of a link mechanism for utilizing the force of the spring to generate the needed moment arm. That link mechanism is described hereinafter.

Figure 6:
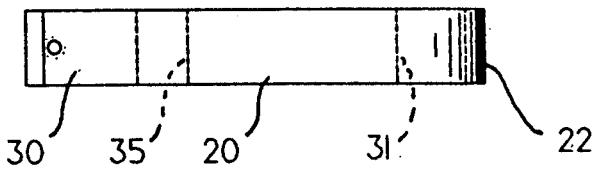
FIG. 6 is a top view of the arcuate shaped link illustrated in FIG. 5.
Figure 5:
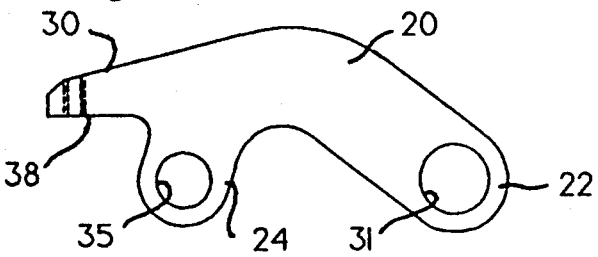
FIG. 5 is a front view of an arcuate shaped link.

The link mechanism is comprised, in one embodiment, of an arcuate shaped link 20, shown in FIGS. 5 and 6, having a mating end 22 adapted for insertion into a groove 45 formed in the head part 18 of the pull rod 14. The arcuate shaped link 20 also has a hole 31 extending through its mating end 22. Similarly, the arcuate shaped link 20 has a tail end 24 and a hole 35 extending through its tail end 24. The head part 18 of the pull rod 14 is pivotally connected with the arcuate link 20 by a pin 32 which extends through the hole 31 (in the mating end 22) and the holes 33 (in head part 18). A pivot axis 58 seen in FIG. 3 is thus defined by pivot pin 32. Finally, the arcuate shaped link 20 has a protrusion 30 with an engaging surface 38.

Figure 10:
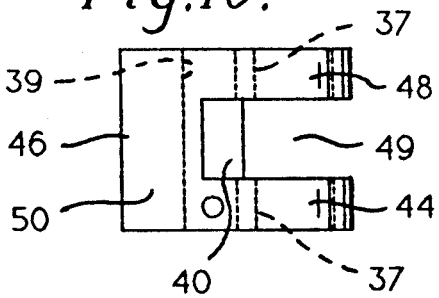
FIG. 10 is a top view of the auxiliary link illustrated in FIG. 9.
Figure 9:
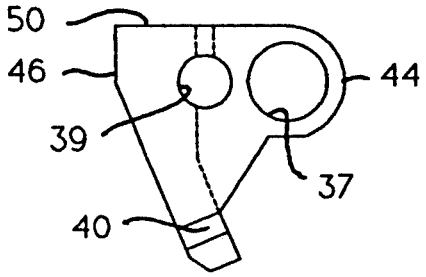
FIG. 9 is a front view of an auxiliary link.
Figure 11:
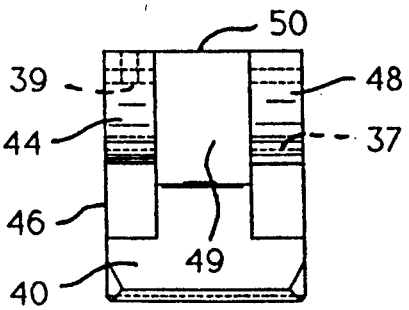
FIG. 11 is a side view of the auxiliary link illustrated in FIGS. 9 and 10.

An Auxiliary link 46 is shown in FIGS. 9, 10 and 11. The auxiliary link, when viewed from the top as in FIG. 10, has a groove 49 formed therein so as to present a substantially U-shaped profile. The walls 44 and 48 forming the U-shape each have a pair of apertures 37 and 39 extending therethrough. The top portion of the auxiliary link seen in FIG. 10 is provided with an abutting surface 50. Completing the description of the auxiliary link 46, an angular protusion 40 is provided which is best seen in FIG. 9.

The tail end 24 of the arcuate shaped link 20 is adapted for insertion into the groove 49 of the auxiliary link 46. The arcuate shaped link 20 is pivotally connected to the auxiliary link 46 by a pin 34 which extends through the hole 35 (in the arcuate link 20) and the holes 37 (in the auxiliary link 46). A pivot axis 56, seen in FIG. 3, is thus defined by pivot pin 34 about which the auxiliary link 46 pivots with respect to the arcuate shaped link 20. The auxiliary link 46 is also pivotally connected to the upper arm extension 26 by a pin 36 which extends through holes 39 in walls 44 and 48. A pivot axis 54, seen in FIG. 3, is thus defined by pivot pin 36 about which the auxiliary link 46 pivots with respect to the upper arm extension 26.

The aforedescribed embodiment of the invention operates in two different modes, a first mode when the angle between the upper arm portion 9 and the lower arm portion 10 is approximately 90 degrees or larger and a second mode when the angle between the upper arm portion 9 and the lower arm portion 10 is less than approximately 90 degrees. In the first mode of operation, the auxiliary link 46 remains fixed. The arcuate link 20 transmitts the force developed by the spring 15 through the non-moving auxiliary link 46 to the upper arm portion 10 to thereby develop the moment needed to counterbalance the weight of the lighthead.

In the second mode of operation, when the angle between the upper arm portion 9 and the lower arm portion 10 is approximately 90 degrees, the engaging surface 38 of the arcuate shaped link 20 contacts the abutting surface 50 of the auxiliary link 46. As the angle decreases, the engaging surface 38 remains in contact with the abutting surface 50 thereby causing the position of the auxiliary link 46 to continually change. The moment arm is thus extended by the arcuate shaped link 20 and the auxiliary link working in unison to provide the necessary counterbalance when the angle between the upper arm portion 9 and the lower arm portion 10 is approximately 90 degrees or smaller.

Lastly, it should be noted that the arcuate shaped link 20 has a sufficient arc so that the lighthead can be moved from a position where the upper arm portion 9 and lower arm portion 10 form an acute angle to a position where that angle is 180 degrees without the link 20 interfering with the pivot pin 29.

In summary, a link mechanism is thus provided whereby the weight of the lighthead is counterbalanced at any angle between the upper and lower arms. When the angle between the upper and lower arms is in the range of 180 degrees to 90 degrees, the arcuate shaped link 20 operates with the spring 15 and pull rod 14 to counterbalance the lighthead. At angles of 90 degrees and less, the arcuate shaped link 20 acts in unison with the auxiliary link 46 to extend the moment arm so that the lighthead is counterbalanced at those angles.

Figure 8:
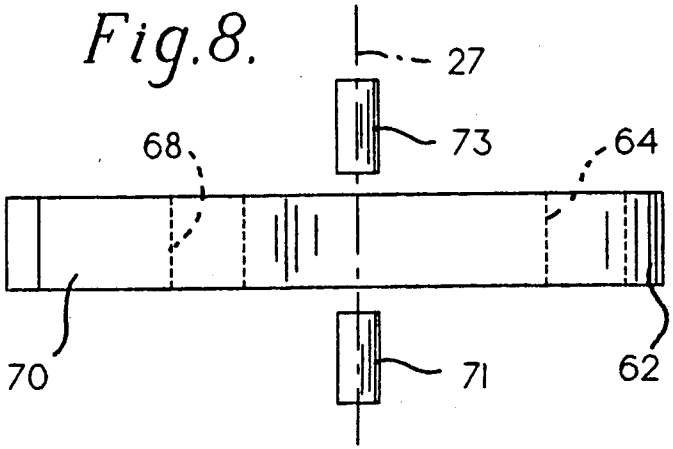
FIG. 8 is a view of the straight link and split pivot pin.
Figure 7:
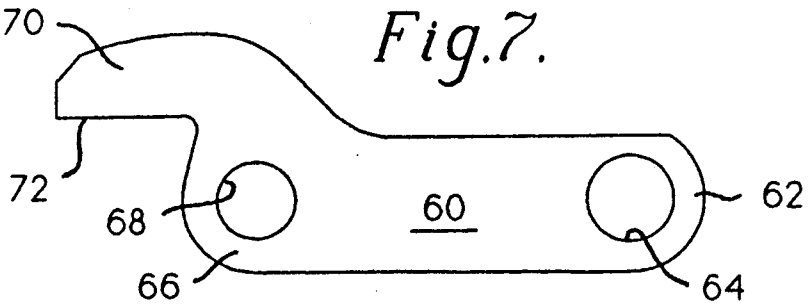
FIG. 7 is a front view of a straight link.

In another embodiment, the arcuate shaped link 20 is replaced by a straight link 60 as best seen in FIGS. 7 and 8. The straight link 60 has a first end 62 having a hole 64 extending therethrough, and a second end 66 having a hole 68 extending therethrough. The straight link 60 has a protrusion 70 with an engaging surface 72. The grove 45 of the head part 18 of the pull rod 14 is adapted for receiving the first end 62 of the straight link 60. The pin 32 extends through holes 33 and 64 to pivotally connect the pull rod 14 to the straight link 60. The pivot axis 58 is defined by the pin 32 whereby the straight link 60 pivots with respect to the pull rod 14.

The grove 49 of the auxiliary link 46 is adapted for receiving the second end 66 of the straight link 60. The pin 34 extends through holes 37 and 68 to pivotally connect the straight link 60 to the auxiliary link 46. The pivot axis 56 is thus defined by the pin 34 about which the auxiliary link 46 pivots with respect to the straight link 60. The engaging surface 72 of the straight link 60 contacts the abutting surface 50 of the auxiliary link 46 when the angle between the upper arm portion 9 and lower arm portion 10 is approximately 90 degrees or smaller. The moment arm is thus extended by the straight link working in unison with the auxilliary link 46 to provide the necessary counterbalance when the angle between the upper arm portion 9 and the lower arm portion 10 is approximately 90 degrees or smaller.

In that embodiment, the pivot pin 29 is replaced with a pair of opposing pins 71 and 73 extending partially along the pivot axis 27 as seen in FIG. 8. A discontinuity in the pivot axis 27 is thus created so that the straight link 60 may operate through the discontinuity.

In either of the pivot assembly embodiments, because of the arcuate shaped link 20, or the straight link 60 operating with opposing pins 71, 73, it is possible to move the lighthead from a position in which the lower arm portion 10 forms a 180 degree angle with the upper arm portion 9, to a position in which the lower arm portion 10 forms an acute angle with the upper arm portion 9. Throughout that whole range of angles, the weight of the lighthead is precisely counterbalanced so that the lighthead remains in the position in which it is placed and will not move without the application of an external force.

Those of ordinary skill in the art will recognized that numerous modifications and variations are possible. The foregoing description and the following claims are intended to cover all such modifications and variations.

What we claim is:

1. A counterbalanced arm for a lighthead, comprising:

an upper arm portion;

an upper arm extension connected to said upper arm portion at one end and having two flanges at the other end;

a lower arm portion having a first and second end, and adapted at said first end to be connected to the lighthead;

a lower arm extension, connected at one end to said second end of said lower arm portion and having two flanges at the other end adapted for connection to said flanges of said upper arm extension;

pivot means connecting said flanges of said upper arm extension and said flanges of said lower arm extension, said pivot means defining a pivot axis about which said lower arm portion pivots with respect to said upper arm portion;

lever means comprising an arcuate link having a first end and a second end;

pull rod means positioned within said lower arm portion and pivotally attached to said second end of said arcuate link; and preloaded spring means comprising a beveled washer spring having a cylindrical opening concentric with the longitudinal axis of said beveled washer spring, said pull rod means extending through said cylindrical opening, the force of said spring means acting through said pull rod means on said lever means to provide a counterbalance for the lighthead, said lever means additionally including an auxiliary link having a first end pivotally connected to said upper arm extension and a second end pivotally connected to said first end of said arcuate link, said auxiliary link operative to extend the moment arm of said lever means to enable the counterbalanced arm to counteract the weight of the lighthead when said lower arm portion forms an acute angle with said upper arm portion, said pivot means and said lever means being constructed to enable said lower arm portion to pivot about said pivot axis from a position forming an acute angle with respect to said upper arm portion to a position forming a 180 degree angle with said upper arm portion.

2. A counterbalanced arm for a lighthead, comprising:

an upper arm portion;

a lower arm portion adapted at one end to be connected to the lighthead and at the other end for articulation about said upper arm portion;

pivot means connecting said upper arm and said lower arm portion, said pivot means defining a pivot axis about which said lower arm portion pivots with respect to said upper arm portion;

lever means having a first end positioned on one side of said pivot axis and a second end positioned on said other side of said pivot axis, said lever means having an arcuate shaped link, said lever means additionally having an auxiliary link having a first end pivotally connected to one of said upper and lower arm portions and a second end pivotally connected to one end of said arcuate shaped link, said auxiliary link operative to extend the moment arm of said lever means to enable the counterbalanced arm to counteract the weight of the lighthead when said lower arm portion forms an acute angle with said upper arm portion, said arcuate shaped link having a sufficient arc to enable said lower arm portion to pivot about said pivot axis from a position forming an acute angle with respect to said upper arm portion to a position forming a 180 degree angle with said upper arm portion;

pull rod means positioned within the one of said upper and lower arm portions which is not connected to said first end of said auxiliary link and pivotally attached to said second end of said lever means;

spring means operatively connected to said pull rod means such that said spring means provides a force to counterbalance the lighthead.

3. A counterbalanced arm as recited in claim 2 wherein said lever means comprises a first end pivotally secured to said upper arm portion and a second end pivotally secured to said pull rod means.

4. A counterbalanced arm recited in claim 2 wherein said lever means comprises a first end pivotally secured to said lower arm portion and a second end pivotally secured to said pull rod means.

5. A counterbalanced arm as recited in claim 2 wherein said spring means comprises a beveled washer spring having a cylindrical opening concentric with the longitudinal axis of said beveled washer spring, said pull rod means extending through said cylindrical opening, said pull rod means having an end being acted on by said beveled washer spring.

6. A counterbalanced arm as recited in claim 5 further comprising a pair of low friction rings said low friction rings being mounted within said arm portion carrying said pull rod so as to guide said pull rod within said arm portion.

7. A counterbalanced arm as recited in claim 5 wherein said beveled washer spring is preloaded so as to exert a force on said lever means sufficient to generate a moment arm to counteract the weight of the light-head.

* * * * *

UNITED STATES PATENT AND TRADEMARK OFFICE

CERTIFICATE OF CORRECTION

PATENT NO. : 5,025,359

DATED : June 18, 1991

INVENTOR(S) : Raja Saluja and Arthur T. Nagare

It is certified that error appears in the above-identified patent and that said Letters Patent is hereby corrected as shown below:

Col. 3, line 23, delete "washing" and substitute --washer-- therefor.

Col. 4, line 3, delete "Auxiliary" and substitute --auxiliary-- therefor.

Col. 5, line 13, delete "grove" and substitute --groove-- therefor.

Col. 5, line 46, delete "recognizid" and substitute --recognize-- therefor.

Col. 6, line 36, after "arm" insert --portion--.

Signed and Sealed this

Twenty-ninth Day of December, 1992

*Attest:*

DOUGLAS B. COMER

*Attesting Officer*

*Acting Commissioner of Patents and Trademarks*